US005934339A

United States Patent [19]

Ramsey

[11] Patent Number: 5,934,339

[45] Date of Patent: Aug. 10, 1999

[54] VARIED COIL SPRING INTERIOR FORMING METHOD AND APPARATUS

[75] Inventor: Henry R. Ramsey, Dudley, Mass.

[73] Assignee: L&P Property Management Company, South Gate, Calif.

[21] Appl. No.: 08/916,493

[22] Filed: Aug. 22, 1997

[51] Int. Cl.[6] ..... B21F 27/16

[52] U.S. Cl. ..... 140/3 CA; 140/92.7

[58] Field of Search ..... 140/3 CA, 92.7; 29/785

[56] References Cited

U.S. PATENT DOCUMENTS

| | | | |
|---|---|---|---|
| 3,386,561 | 6/1968 | Spuhl . | |
| 3,774,652 | 11/1973 | Sturm . | |
| 4,111,241 | 9/1978 | Crown | 140/92.7 |
| 4,406,359 | 9/1983 | Cole et al. . | |
| 4,413,659 | 11/1983 | Zangerle . | |
| 4,416,058 | 11/1983 | Henry, Sr. et al. | 29/736 |
| 4,625,349 | 12/1986 | Higgins . | |
| 4,705,079 | 11/1987 | Higgins . | |
| 4,750,728 | 6/1988 | Keller . | |
| 4,756,400 | 7/1988 | Funo et al. . | |
| 4,860,880 | 8/1989 | Hinchcliffe et al. . | |
| 4,863,010 | 9/1989 | Proksa et al. . | |
| 5,579,810 | 12/1996 | Ramsey et al. | 140/92.7 |

FOREIGN PATENT DOCUMENTS 1917715 10/1970 Germany .

*Primary Examiner*—Lowell A. Larson
*Attorney, Agent, or Firm*—Wood, Herron & Evans, L.L.P.

[57] ABSTRACT

A method and an apparatus are provided for producing sequences of coil springs of more than one configuration, such as those differing in stiffness, shape, size or other property. At least two coiling stations are provided around different positions of a rotary index mechanism that has a plurality of angularly spaced spring holders that are sequentially moved through and rest simultaneously at a plurality of forming or other treating stations around a central axis. The coiling stations alternatively deliver coiled springs to each holder, while one or more post forming stations, preferably including two knotting stations and one heat treating station, sequentially operate on each of the springs of the different configurations. A transfer station transfers finished springs to a conveyor that transfers programmed sequences of springs, row by row, to a spring interior assembler. The stations are controlled to simultaneously perform different operations on different springs, including different types of springs. Springs of different rows are formed or post formed or treated simultaneously at different ones of the stations.

14 Claims, 3 Drawing Sheets

ROW 1 ROW 2

| STATION | 61a | 61b | 61c | 61d | 61e | 61f | 61g | 61h | 61i | 61j | 61k | 61l | 61m | 61n | 61o | 62a 61p | 62b 61q | 62c 61r | 62d 61s | 62e 61t | 62f 61u | 62g 61v | 62h |
|---|---|---|---|---|---|---|---|---|---|---|---|---|---|---|---|---|---|---|---|---|---|---|---|
| COILER A 31 | A | A | | | | | A | A | A | | | | | A | A | A | A | | | | | A | A |
| IDLE 44 | | A | A | | | | | A | A | A | | | | | A | A | A | A | | | | | A |
| COILER B 32 | | | A | A | B | B | B | B | A | A | A | B | B | B | B | A | A | A | A | B | B | B | B |
| TOP KNOTTER 33 | | | | A | A | B | B | B | B | A | A | A | B | B | B | B | A | A | A | A | B | B | B |
| BOTTOM KNOTTER 34 | | | | | A | A | B | B | B | B | A | A | A | B | B | B | B | A | A | A | A | B | B |
| HEAT TREAT 35 | | | | | | A | A | B | B | B | B | A | A | A | B | B | B | B | A | A | A | A | B |
| OTHER 45 | | | | | | | A | A | B | B | B | B | A | A | A | B | B | B | B | A | A | A | A |
| TRANSFER 36 | | | | | | | | A | A | B | B | B | B | A | A | A | B | B | B | B | A | A | A |

FIG.6

VARIED COIL SPRING INTERIOR FORMING METHOD AND APPARATUS

The present invention relates to the formation and assembly of coil spring interiors, and particularly to a method and apparatus for forming, feeding and positioning coils for assembly into such spring interiors.

BACKGROUND OF THE INVENTION

In the manufacture of spring interiors such as are used to provide the inner spring assemblies of mattresses and similar products, spring assembler machines are employed to lace together rows of coil springs into arrays that are usually rectangular. Such arrays of springs are usually assembled as a plurality of vertically oriented helical coil springs often having hour-glass shapes, arranged horizontally in a grid that lies in a plane. The more preferred arrangements of spring interior manufacturing machines include a coil former, which makes individual springs from continuous wire, that feeds coil springs as they are formed to the assembly apparatus.

Efficient production of spring interiors is largely dependent on the speed with which springs can be fed to the assembler. Where the array of springs is made up of a plurality of identical springs evenly spaced in each of the rows, devices have been provided for automatically feeding rows of the springs to a transfer device and then translating the row with a multiple gripper mechanism bodily into the assembler, parallel to the previously transferred rows. One early version of such a machine is disclosed in U.S. Pat. No. 3,386,561 to Spühl and a later version is disclosed in U.S. Pat. No. 3,774,652 to Strum. Such machines avoid the extra handling associated with loading the springs by coupling the output conveyor of a spring forming machine directly to the infeed of the transfer mechanism. As a rule, the speed of such a combination is limited by the spring coiling machine, which produces individual springs slower than the assembler can assemble them.

Other spring interior forming machines equipped with a coil former are further provided with the capability of knotting, crimping or otherwise reforming heads on the coils after the coils are formed and before assembly of the spring interior. One such machine is described in U.S. Pat. No. 4,111,241, which is hereby expressly incorporated by reference herein.

Attempts to speed up the spring interior assembly operation have led to the use of two coil forming machines instead of one, arranged with their output conveyors in parallel rows that extend through a transfer station. Such a combination is disclosed in U.S. Pat. No. 4,413,659 to Zängerle. In such a combination, the gripper mechanism at the transfer station operates to transfer rows of springs alternately from each of the output conveyors from the coilers, allowing one of the coilers to operate to produce one row of coils while the row of coils previously formed by the other coiler is being transferred to the assembler. With such an arrangement, each coiler may use the time required for two of the assembler machine cycles to produce one row of springs. Such an apparatus, however, still presents evenly spaced rows of coils to the transfer mechanism.

Many spring interior products are better formed when the coil springs are not uniformly spaced in the rows. However, combination machines of the type described above produce a steady stream or series of formed springs at the output of the coiler and present the coils to the transfer mechanism spaced evenly in rows. Where irregularly spaced coils are required, it has been necessary to feed the coils to the transfer mechanism evenly spaced to the average desired coil spacing and then to employ independently moveable grippers to transfer each of the springs to the assembler, moving different springs transversely in differing amounts in the transfer to achieve the desired irregular spring spacing. Assemblers with transfer mechanisms having such capability are illustrated and described in U.S. Pat. Nos. 4,625,349 and 4,705,079 to Higgins, both hereby expressly incorporated by reference herein.

Even with the utilization of a spacing altering gripper mechanism at the transfer station, many spring interior designs benefit from not only springs that are irregularly spaced, but include combinations of springs of more than one type, size or stiffness in each row. Direct connection of the output conveyors of spring coilers to the infeed of a transfer station does not alone provide such a capability. Accordingly, various manual steps are required in the handling of the springs fed to a spring interior assembler in order to produce many of the desired products. One such system which provides speed of operation and flexibility in the spacing and arrangement of springs is disclosed in U.S. Pat. No. 5,579,810, which is hereby expressly incorporated by reference herein.

The machines of the prior art do not provide the capacity, speed, flexibility of variable spring spacing or of mixing the types of springs that are presented on the conveyor to the transfer mechanism that feeds a spring interior assembly machine. Accordingly, there remains a need for faster and more flexible spring assembly methods and machines.

SUMMARY OF THE INVENTION

A primary objective of the present invention is to provide a spring interior assembly method and apparatus that will provide flexibility in the spacing and selection of springs that form the spring interior array, particularly where the knotting, crimping or other reforming of the heads of the springs must be carried out after formation of the springs and before the spring interior is assembled. It is a more particular objective of the present invention to provide a spring interior forming method and apparatus in which springs can be formed and sent directly to a spring interior assembler particularly with springs of more than one size, stiffness or type, and supplied to the assembler in various sequences.

Still a further objective of the present invention is to provide a method and apparatus for producing springs and feeding them directly to a spring interior assembly machine where the springs are of various sizes, stiffnesses or types, and where the heads of the springs may be crimped, knotted or otherwise reformed, and to present such coils to an assembler in accordance with a programmable or selectable sequence. This provides for the assembly of a mattress having more than one different firmness or pressure zones.

In accordance with the principles of the present invention, a spring interior assembling method and apparatus are provided with a plurality of on-line coilers each having an outfeed connected to a mechanical or servo driven indexing mechanism that selectively feeds coils from the coilers through one or more head reforming stations at which the heads may be crimped, knotted or otherwise reformed in accordance with one or more coil designs. Preferably, the outfeeds of the coilers are synchronized with the operation of the indexing mechanism and the operation of one or more head forming stations by a programmable controller which causes the operation of the coilers, the indexing mechanism, the head forming stations and preferably also a spring interior assembler to produce spring interiors having coils of more than one size, stiffness or type, in accordance with one of several predetermined specifications.

These and other objectives and advantages of the present invention will be more readily apparent from the following detailed description of the drawings and preferred embodiments, in which:

BRIEF DESCRIPTION OF THE DRAWINGS

FIG. 6 is a table illustrating the station locations of different coil spring types during operation of the apparatus of FIG. 3.

DETAILED DESCRIPTION OF THE PREFERRED EMBODIMENTS

Figure 1:
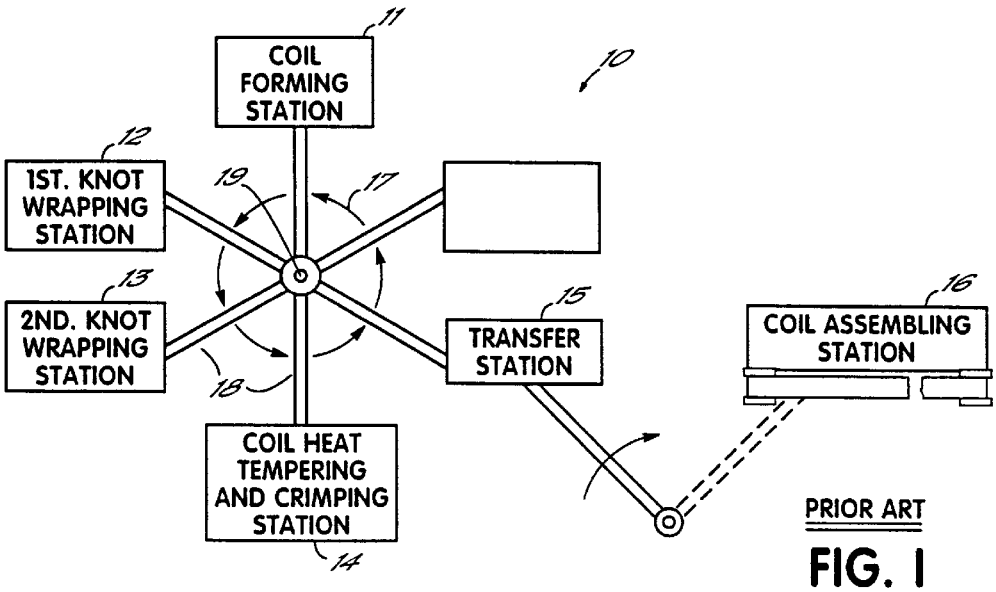
PRIOR ART FIG. 1
FIG. 1 is a diagrammatic representation of a spring coil making and spring interior assembly machine of the prior art.

Referring to FIG. 1, a spring forming and assembling machine 10 of the prior art is diagrammatically represented. The machine 10 is described and illustrated in more detail in U.S. Pat. No. 4,111,241, expressly incorporated by reference herein. The machine 10 includes a coil forming station 11 at which a length of wire is continuously fed and formed into a series of individual coils. The machine 10 also includes two knotting stations 12 and 13 at which knots are successively formed at the ends of each coil produced at the coil forming station 11. Also provided in the machine 10 is a heat treating or tempering station 14 which may also include an indentation or crimping device for crimping the coil heads. Finally, the machine 10 is provided with a transfer station 15 from which formed coils are delivered to a coil assembly station 16 where they are accumulated in rows and then interconnected with previously arranged rows in a coil array and formed into a spring interior.

The machine 10 is provided with an indexing mechanism 17 which includes a plurality of spoked arms 18 and an indexing drive (not shown) that is typically of a type similar to a Geneva mechanism or similar device. The transfer arms 18 are fixed to and radiate from a central hub 19 that is rotatably supported at its center.

Figure 2:
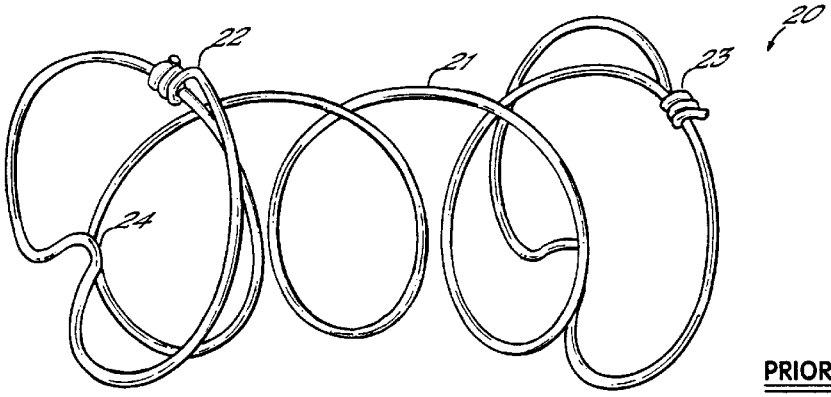
PRIOR ART FIG. 2
FIG. 2 is a perspective view of a knotted coil of a type formed on the machine of FIG. 1.

FIG. 2 illustrates a typical hour glass type coil spring 20 of the type formed in the machine 10. The spring 20 includes a coil portion 21 formed at the coiler 11 from a continuous supply of wire. When the coil portion 21 is formed, the indexing mechanism 17 picks up the partially formed coil 20 at the coiling station 11 on one of the arms 18 and rotates to transfer the coil 20 to the first knotting station 12, at which a knot 22 is formed in one end of the coil 20. While the knot 22 is being formed, another coil portion 21 may be in the process of being formed at the coiler station 11. When the knot 22 has been formed, the transfer mechanism 17 transfers the once knotted coil 20 from the first knot forming station 12 to the second knot forming station 13, at which a second knot 23 is formed in the other end of the coil 20. During the transfer of the once knotted coil from station 12 to station 13, another formed and unknotted coil may be simultaneously transferred from the coiler station 11 to the first knotting station 12 on another one of the transfer arms 18.

When the knot 23 has been formed, the transfer mechanism 17 transfers the twice knotted coil 20 from the second knot forming station 13 to the heat treating station 14, at which an electrical current is applied to the coil to quickly heat the coil 20 and temper it. At this station 14, a crimp 24 may also be formed in one or both heads of the coil 20. During the transfer of the twice knotted coil from station 13 to station 14, a once knotted coil may be simultaneously transferred from the first knotting station 12 to the second knotting station 13 on another one of the transfer arms 18, while another formed and unknotted coil may be simultaneously transferred from the coiler station 11 to the first knotting station 12 on still another one of the transfer arms 18.

When the coil 20 has been tempered at the heat treating station 14, the transfer mechanism 17 transfers the coil 20 from the treating station 14 to the transfer station 15 for transfer to the assembly station 16. During the transfer of the tempered coil from station 14 to station 15, a twice knotted coil may be simultaneously transferred from the second knotting station 13 to the heat treating station 14 on another one of the transfer arms 18, while a once knotted coil may also be simultaneously transferred from the first knotting station 12 to the second knotting station 13 on still another one of the transfer arms 18, while a further formed and unknotted coil may be simultaneously transferred from the coiler station 11 to the first knotting station 12 on still a further one of the transfer arms 18.

Figure 3:
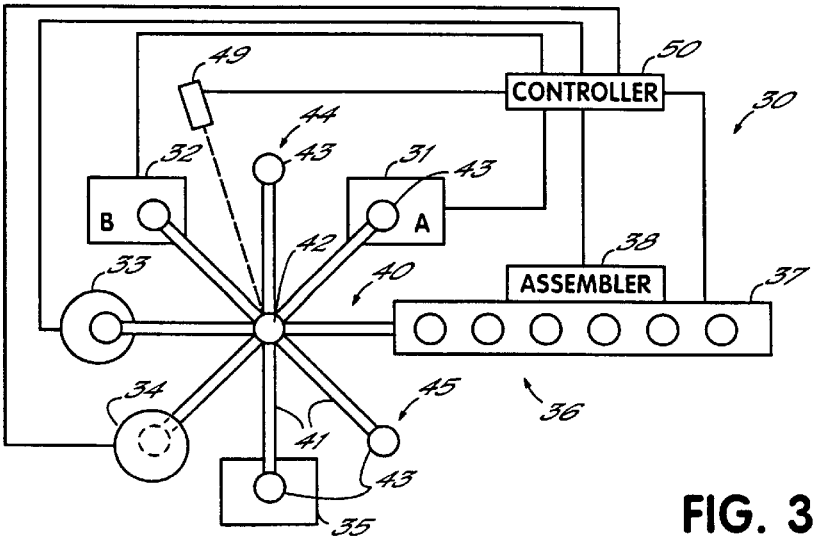
FIG. 3 is a diagrammatic representation of a spring coil making and spring interior assembly machine according to principles of the present invention.

FIG. 3 illustrates a spring forming and assembly machine 30 according to one preferred embodiment of the present invention. The machine 30 includes a first coil forming station 31 at which a length of wire is continuously fed and formed into a series of individual coils, particularly the coil portions 21 of coils such as coil 20 of FIG. 2. The coil 20 formed at the station 31 is typically restricted in type to that which the station 31 is configured to form. In any event, the station 31 will typically have fed thereto a wire of a particular gage and wire composition from a single wire supply. The coil 20 produced at the station 31 will thus be of a particular size, type and stiffness.

The machine 30 is also provided with one or more second coil forming station 32 at which a length of wire, which may be a different wire than is fed to station 31, is continuously fed and formed into a series of individual coils. The coil 20 formed at the station 32 is also typically restricted in type to that which the station 32 is configured to form, and will typically be formed of a wire of a particular gage and wire composition from a single wire supply. The coil 20 produced at the station 32 will also be of a second particular size, type and stiffness.

The machine 30 also includes two knotting stations 33 and 34, which may be similar to the stations 12 and 13, respectively, of machine 10, described above. At the stations 33 and 34, knots are successively formed at the ends of each coil produced at the coil forming stations 31 and 32. Also provided in the machine 30 is a heat treating or tempering station 35, which may be similar to the heat treating station 14 of the machine 10, described above, and which may also include an indentation or crimping device for crimping the coil heads. Additionally, the machine 30 is provided with a transfer station 36 from which formed coils 20 are accumulated in one or more rows on a conveyor 37 and transferred into an assembler 38 where they are interconnected with previously arranged rows in a coil array and formed into a spring interior.

The machine 30 is also provided with an indexing mechanism 40, which may be similar to the mechanism 17 of the machine 10 described above. The indexing mechanism 10 includes a plurality of spoked arms 41 and an indexing drive 49 that may be of a type similar to a Geneva mechanism or may be in the form of a servo or indexing motor type or other suitable drive. The transfer arms 41 are fixed to and radiate from a central hub 42 that is rotatably supported at its center. The arms 41 are preferably eight in number and are preferably equally angularly spaced around the hub 42. The machine 30 may also be provided with one or more other stations 44 and 45 which may be equipped with devices for performing other operations. The stations 31, 44, 32, 33, 34, 35, 45 and 36 are, in the preferred embodiment, spaced at equal angular intervals around the axis of the hub 41 at the same angular intervals as the spacing of the arms 41. These intervals are, in the preferred eight station embodiment, each 45°. As a result, each of the coil spring supports or holders 43 at the ends of the arms 41 will be simultaneously located at one of the stations so that operations at the various stations may be carried out simultaneously on different coils held by different supports 43.

The machine 30 is provided with a controller 50, which controls the operation of the machine 30 to produce coils 20 of different types, sizes or stiffnesses from the coilers 31 and 32, and to arrange them in different configurations in an array at the assembler 38. Under the control of the controller 50, a coil portion 21 of a coil 20, for example, is formed, at the station 31, into a coil 20 of a type, stiffness and size as determined by the configuration of the station 31 and the type of wire supplied thereto. When the coil portion 21 of the coil 20 has been formed at the station 31, the indexing mechanism 40 picks up the partially formed coil 20 at the coiling station 31 on one of the arms 41 and rotates to transfer the coil 20 to the next station, which is illustrated as the idle station 44. If the next coil 20 to be produced, according to the program of the controller 50, is to also be a coil from the coiler 31, such a coil is formed and picked up by the next transfer arm 41 when the first coil is at station 44. On the other hand, if the next coil in the program in the controller 50 is to be a different type of coil, the transfer mechanism 40 may rotate until the previously made coil is, for example, at the first knotting station 33, at which a knot 22 is formed in one end of the coil 20. While the knot 22 is being formed, another coil portion 21 may be in the process of being formed at the coiler station 32.

When the knot 22 has been formed, the transfer mechanism 40 transfers the once knotted coil 20 from the first knot forming station 33 to the second knot forming station 34, at which a second knot 23 is formed in the other end of the coil 20. During the transfer of the once knotted coil from station 33 to station 34, another formed and unknotted coil of a different size, type or stiffness may be simultaneously transferred from the second coiler station 32 to the first knotting station 33 on another one of the transfer arms 41. When the knot 23 has been formed, the transfer mechanism 41 transfers the twice knotted coil 20 from the second knot forming station 34 to the heat treating station 35, at which an electrical current is applied to the coil to quickly heat the coil 20 and temper it. At this station 35, a crimp 24 may also be formed in one or both heads of the coil 20. During the transfer of the twice knotted coil from station 34 to station 35, a once knotted coil may be simultaneously transferred from the first knotting station 33 to the second knotting station 34 on another one of the transfer arms 41, while another formed and unknotted coil may be simultaneously transferred from either coiler 31 or coiler 32 to a subsequent station 44 or 33, respectively, on still another one of the transfer arms 41.

When the coil 20 has been tempered at the heat treating station 35, the transfer mechanism 40 transfers the coil 20 from the treating station 35 to the transfer station 36 for transfer to the assembly station 37 via the conveyor 38. During the transfer of the tempered coil from station 35 to station 36, a twice knotted coil may be simultaneously transferred from the second knotting station 34 to the heat treating station 35 on another one of the transfer arms 41, while a once knotted coil may also be simultaneously transferred from the first knotting station 33 to the second knotting station 34 on still another one of the transfer arms 41, while a further formed and unknotted coil may be simultaneously transferred from either coiler station 31 or coiler station 32 to station 44 or the first knotting station 33, respectively, on still a further one of the transfer arms 41.

Figure 4:
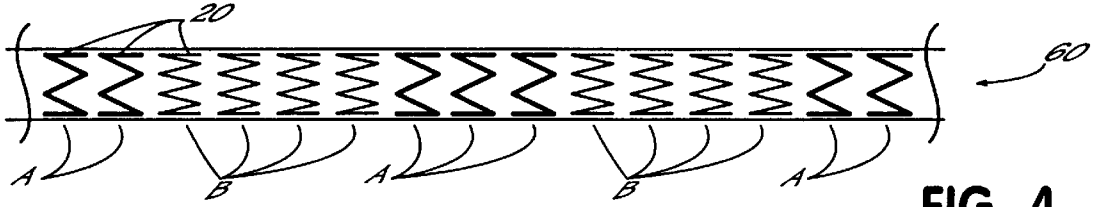
FIG. 4 is a diagram representing a sample row of differently configured coil springs produced by an apparatus.

FIG. 4 diagrammatically illustrates a row 60 of coil springs 20 that are of two configurations. Springs 20 of the configuration designated A are, for example, stiffer springs of heavier wire and of fewer turns, while springs 20 of the configuration designated B are, for example, less stiff springs of lighter wire and of more turns. The row 60 of springs 20 includes a sample sequence of the two configurations of coils 20 of 2 A coil springs, 4 B coil springs, 3 A coil springs, 4 B coil springs and 2 A coil springs, for a total of 15 springs per row.

Figure 5:
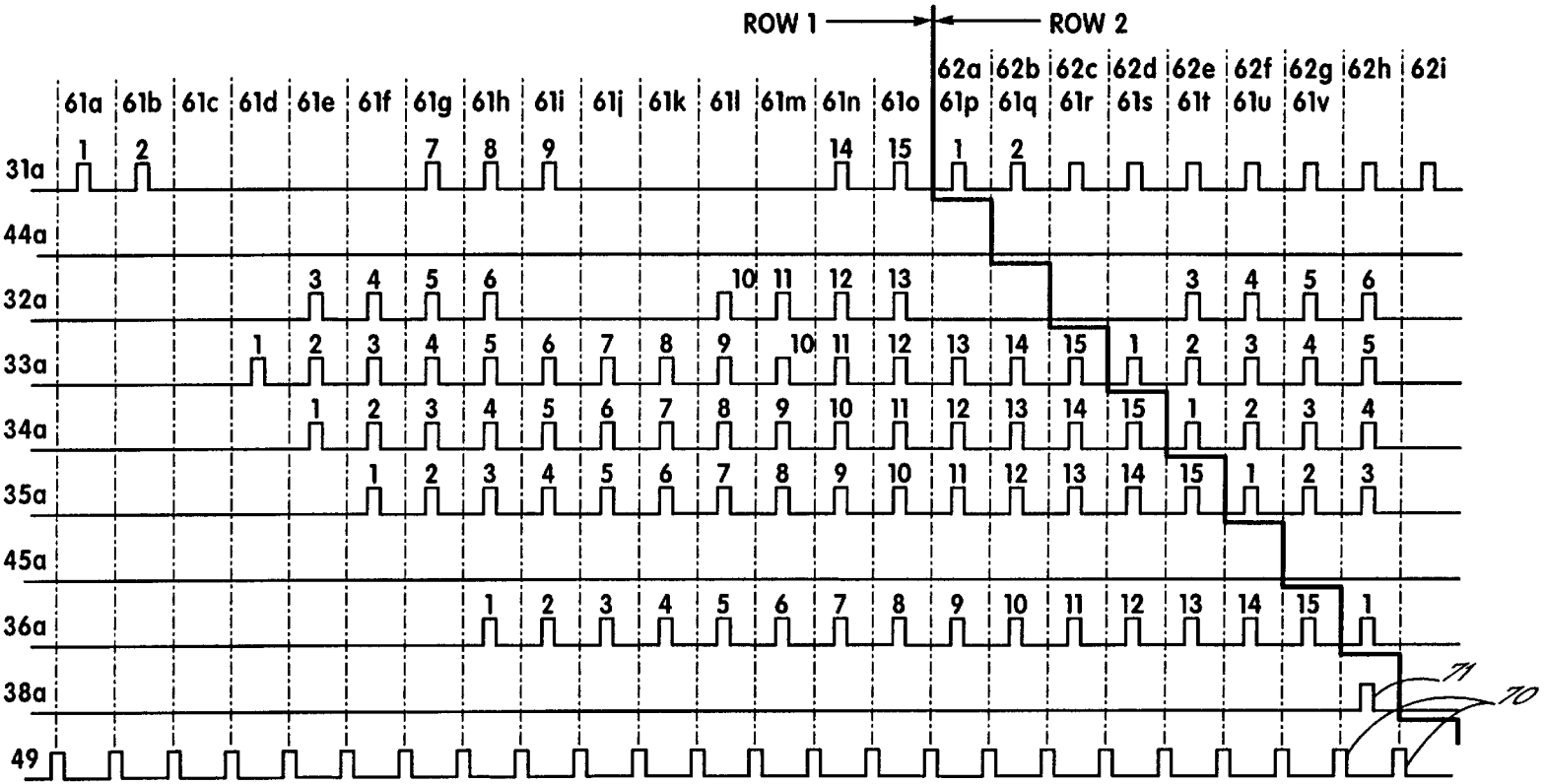
FIG. 5 is a timing diagram illustrating a sequence of operation of the apparatus of FIG. 3 for producing rows of coil springs such as illustrated in FIG. 4.

FIG. 5 illustrates a timing diagram of the control signals 31*a*–36*a* and 38*a* (and 44*a* and/or 45*a* if such signals are used) from the controller 50 to the two coiling stations 31 and 32, the two knotting stations 33 and 34, the treating station 35, the transfer station 36 and the trigger signal to the assembler 38. These signals operate the machine 30 to produce a plurality of similar rows 60. However, not all rows need be identical, but each may be made in accordance with a program of the controller 50 that produces rows that employ different combinations of springs 20. The diagram illustrates the timing of trigger signals, numbered 1 to 15, sent to each of the stations during a row production cycle, which is divided into a 15 sub-cycles or intervals 61*a* to 61*o*, one for each of the springs 20 of a row 60. FIG. 6 illustrates the configuration of spring, A or B, in the support or holder 43 of the indexing mechanism 40 at each of the respective stations. Each of these sub-cycles is separated by a signal 70 from the controller 50 to the drive 49 of the indexing mechanism 40.

Specifically, in the illustrated example, the operation proceeds in interval 61*a* with a signal to the coiler station 31 to coil a first coil spring of an A configuration and place it in the holder 43 at that location. Then an indexing pulse 70 causes the indexing mechanism to move this A type spring to station 44 while an empty support 43 is moved to the station 31. Then, in interval 61*b*, another coil spring of an A configuration is formed at station 31 and placed in the holder 43 at that location. Then an indexing pulse 70 causes the indexing mechanism to move this A type spring from station 31 to station 44 and the first coiled spring from station 44 to station 32 while another empty support 43 is moved to the station 31. Since the next coil configuration called for in the program of the controller 50 is of the B type, no operations take place in interval 61*c*. Another indexing pulse 70 is then sent by the controller 50 to the drive 49, causing the A type coil from station 32 to be moved to the first knotting station 33 while the coil at station 44 is moved to station 32. In interval 61*d*, the top end of the coil at station 33 is knotted. Then an indexing pulse indexes the indexing mechanism 40 to move the knotted A coil from station 33 to station 34, the unknotted Aa coil from station 32 to 33, an empty holder from station 44 to coiler station 32 and an empty holder 43 from station 31 to station 44. In interval 61*e*, the bottom end of the first coil is knotted at station 34, while a coil spring of the B configuration is coiled at station 32 and placed in the holder 43 at that location.

The operation continues with an indexing pulse being sent to the drive 49 of the indexing mechanism while control signals are sent to each of the stations during the remaining intervals 61*f*–61*o* in accordance with the diagrams of FIGS. 5 and 6. In interval 61*o*, an empty holder 43, which is to receive the last coil spring 20 of a row 60, is positioned at the coiling station 31, where, in the example illustrated, another coil spring of an A configuration is formed at station 31 and placed in the holder 43 at that location, while a coil spring of a B configuration is simultaneously formed at station 32 and placed in the holder 43 at that location. Also performed simultaneously are the knotting of the top end of a B coil at knotter station 33, the knotting of the bottom end of another B coil at the knotter station 34, the heat treating of still another B coil at treatment station 35, and the transfer of an A coil to the conveyor 37 for transfer to the assembler 38.

During this interval 61*o*, while the holder 43 for the last coil spring 20 of the row 60 is at station 31, the last seven coil springs 20 of the row 60 will not yet have been completed and transferred to the conveyor 37 at the transfer station 36. In fact, were the final coil 20 of the row 60 to be of a B configuration, an empty holder 43 will, in interval 61*o*, be at station 31, but will not receive the coiled spring until two intervals later when the holder has been indexed to station 32. These coils will be completed and sequentially advanced to and transferred from the transfer station 36 during the intervals 61*p*–61*v*, which are performed simultaneously with the first seven intervals of the next cycle, particularly intervals 62*a*–62*g*, of the machine when coil springs of the next row 60 are being formed, in the same manner as described above.

After the last coil spring of a row has been transferred at transfer station 36, a trigger signal 71 to the conveyor 37 and assembler 38 causes the transfer of the row 60 of fifteen coils 20, in the programmed combination of A and B springs to be fed to the assembler 38. When the final row of coil springs 60 is being formed, the p–g intervals of the final rows are executed without coils for a subsequent row being formed. This is illustrated in FIG. 6.

From the above detailed description of the details of the illustrated embodiments of the invention, it will be apparent to those skilled in the art that various modifications and additions may be made thereto without departing from the principles of the present invention.

Therefore, the following is claimed:

1. A spring interior making apparatus for forming spring interior assemblies of arrays of coil springs of more than one type, comprising:

a spring interior assembler;

a plurality of stations;

an indexing mechanism having a plurality of coil spring holders thereon and operative to sequentially move coil springs, each held by one of the holders, sequentially to and from each of the plurality of stations;

the plurality of stations including:

a transfer station upstream of the assembler and operative to receive a formed coil spring moved thereto by the indexing mechanism for transfer to the assembler, at least two coil spring coiling stations, each operative to form a spring of one of at least two respective given configurations, and at least one post-forming station operative to post-form a coiled spring moved thereto by the indexing mechanism; and a controller, operative to control the operation of the indexing mechanism, the transfer station, coiling stations, and post-forming stations to selectively load each of the holders with a spring of one configuration from one of the coil spring coiling stations and to sequentially deliver a predetermined sequence of formed coils of at least two configurations to the transfer station and then to the assembler.

2. The apparatus of claim 1 wherein:

the at least one post forming station includes two knotting stations, one operative to knot a top end of a coiled spring and one operative to knot a bottom end of the coiled spring, when moved thereto by the indexing mechanism.

3. The apparatus of claim 1 further comprising:

a heat treating station operative to heat treat a coil spring moved thereto by the indexing mechanism.

4. The apparatus of claim 1 wherein:

the indexing mechanism includes an indexing member rotatable about an axis and having the plurality of coil spring holders angularly spaced about the axis.

5. The apparatus of claim 4 wherein:

the stations are each located at one of a plurality of different angularly spaced positions around the axis of the indexing mechanism, and the indexing mechanism is operable to simultaneously move coils of different configurations, one from each of the coiling stations, and sequentially to and from the at least one post-forming station and to the transfer station.

6. The apparatus of claim 1 wherein:

the at least one post forming station includes two knotting stations, one operative to knot a top end of the coiled spring and one operative to knot a bottom end of the coiled spring, when moved thereto by the indexing mechanism;

the apparatus further comprises a heat treating station operative to heat treat a coil spring moved thereto by the indexing mechanism the indexing mechanism includes an indexing member rotatable about an axis and having the plurality of coil spring holders angularly spaced about the axis; and the stations are each located at one of a plurality of different angularly spaced positions around the axis of the indexing mechanism, and the indexing mechanism is operable to simultaneously move coils of different configurations, one from each of the coiling stations, and sequentially to and from each of the post-forming stations, then to and from the heating station and then to the transfer station.

7. A method of forming spring interiors having post-formed coil springs of more than one configuration, the method comprising the steps of:

providing an indexing mechanism operative to cycle a plurality of coil spring holders through each of a plurality of stations;

providing at least two coiling stations among the plurality of stations that are each designed to coil a spring of a different one of at least two coil spring configurations;

providing at least one post forming station among the plurality of stations at which a coiled spring moved to such station on a holder is knotted, crimped or otherwise formed or treated;

alternately indexing the indexing mechanism and operating the stations to move each holder sequentially through each of the coiling stations at only one of which a formed coil is selectively loaded in a holder thereat, then through the at least one post forming station where the coil held in the holder is further formed: and controlling the indexing mechanism and the stations to produce a row of coil springs in a programmed sequence of at least two different ones of the at least two coil spring configurations.

8. The method of claim 7 wherein the alternately indexing and operating step includes the step of:

coiling a coil spring of one configuration at one of the coiling stations while simultaneously coiling a coil spring of a different configuration at another one of the coiling stations.

9. The method of claim 7 wherein the alternately indexing and operating step includes the step of:

coiling a coil spring of one configuration at one of the coiling stations while simultaneously knotting a coiled spring of a different configuration at one of the post forming stations.

10. The method of claim 7 wherein the alternately indexing and operating step includes the step of:

coiling a coil spring of one configuration at one of the coiling stations while simultaneously heat treating a knotted coiled spring of a different configuration at one of the post forming stations.

11. The method of claim 7 wherein the alternately indexing and operating step includes the step of:

knotting a coiled spring of one configuration at one of the post forming stations while simultaneously heat treating a knotted coiled spring of a different configuration at another one of the post forming stations.

12. The method of claim 7 wherein the alternately indexing and operating step includes the step of:

knotting a coiled spring of one configuration at one of the post forming stations while simultaneously knotting a coiled spring of a different configuration at another of the post forming stations.

13. The method of claim 7 wherein the alternately indexing and operating step includes the step of:

sequentially knotting a series of coils of different configurations at at least one of the post forming stations.

14. The method of claim 7 wherein the alternately indexing and operating step includes the step of:

coiling a coil spring of one configuration for one row of a spring interior assembly at one of the coiling stations while simultaneously post forming a coiled spring of a different configuration for a different row of the spring interior assembly at one of the post forming stations.

* * * * *